United States Patent [19]

Forsell

[11] Patent Number: 4,521,756

[45] Date of Patent: Jun. 4, 1985

[54] CIRCUIT BREAKER HAVING INCREASED CONTACT OPENING VELOCITY AT TRIP OPERATION

[75] Inventor: Kenneth A. Forsell, Port Washington, Wis.

[73] Assignee: Eaton Corporation, Cleveland, Ohio

[21] Appl. No.: 559,595

[22] Filed: Dec. 8, 1983

[51] Int. Cl.[3] ..... H01H 5/00

[52] U.S. Cl. ..... 335/21; 335/191; 335/201

[58] Field of Search ..... 335/15, 21, 23, 24, 335/25, 35, 36, 172, 173, 186, 191

[56] References Cited

U.S. PATENT DOCUMENTS 3,193,643 7/1965 Hollyday ..... 335/191

*Primary Examiner*—E. A. Goldberg
*Assistant Examiner*—George Andrews
*Attorney, Agent, or Firm*—C. H. Grace; L. G. Vande Zande

[57] ABSTRACT

A pair of springs (14, 22) provide counteracting rotational bias to a movable contact arm (8) pivotally supported on a latched lever (10). A handle (4) is manually operable for reducing the force applied by one spring (22) to effect contact (6*a*, 8*b*) opening as a result of force applied by the other spring (14). Current sensing means (28, 34, 28*a*) are operable to release the latched lever (10) for releasing the pivot point (12) of the movable contact arm (8) whereby both springs (14, 22) work in a common direction to rapidly separate the contacts (6*a*, 8*b*). Arc gases are exhausted in the direction of separating movement of the movable contact arm (8) to utilize forces associated with arc gas pressure in a cummulative manner with the forces provided by springs (14, 22) to further increase the contact separation speed.

19 Claims, 3 Drawing Figures

CIRCUIT BREAKER HAVING INCREASED CONTACT OPENING VELOCITY AT TRIP OPERATION

BACKGROUND OF THE INVENTION

This invention relates to electric circuit breakers of the narrow width molded case type used in residential and commercial applications.

This type of circuit breaker generally has a handle for manually operating internal contacts between open and closed circuit conditions. In addition to the manual control, the circuit breaker is customarily provided with overcurrent responsive means which sense the current in the circuit being protected by the circuit breaker and operate to trip the circuit breaker to its contact open condition upon detection of currents exceeding a predetermined value. There are two types of overcurrent responsive elements generally employed in circuit breakers, the first being a heat sensing element which responds to low magnitude overcurrents of a prolonged duration. The second type is a magnetic trip device wherein overload currents of short duration and considerably higher magnitude electromagnetically energize a core to attract a magnetic armature thereto. Circuit breakers of this type generally employ both types of overcurrent responsive elements to afford a wide range of overcurrent protection.

The current levels available to residential and commercial customers is progressively increasing. The ability of a circuit breaker to interrupt increased current levels at high overcurrent or fault current conditions is significantly related to the separation speed of the contacts upon detecting such fault. The magnitude of currents now available to comsumers is such that separation of contacts under fault current conditions establishes a strong electrical arc between the contacts. It is necessary to quickly interrupt this arc to prevent harmful currents from being let through the circuit breaker.

SUMMARY OF THE INVENTION

The invention disclosed herein provides an operating mechanism and contact structure for a circuit breaker wherein a movable contact arm is pivotally supported for movement between open and closed contact positions by a pair of springs biasing the arm in opposite pivotal directions. An operating mechanism is manually operable for varying the mechanical moment applied to the movable contact arm by one of the springs between values greater and less than the mechanical moment applied to the arm by the other spring for moving the arm between contact closed and contact open positions. Current responsive trip means are provided which are operable to release the pivotal support of the contact arm whereby the springs provide a combined unidirectional bias on that contact arm for moving the contact arm to an open position in response to overcurrent detection. An arc venting passageway is disposed in the contact separation area for venting the arc in the direction of opening movement of the movable contact member to thereby provide an assisting contact opening force for the movable contact arm. A more complete understanding of the invention will be had from the following description and claims when read in conjunction with the accompanying drawings.

DESCRIPTION OF THE PREFERRED EMBODIMENT

Figure 1:
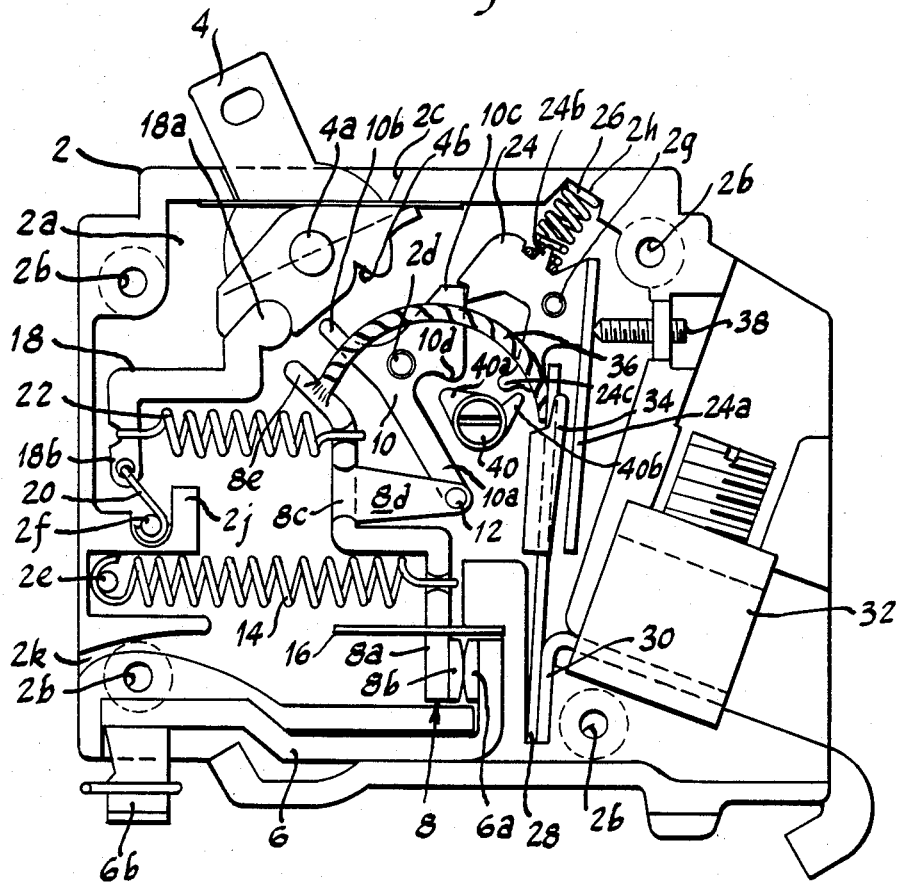
FIG. 1 is a side elevational view of a circuit breaker constructed in accordance with this invention having a cover removed therefrom and showing the mechanism in a contact closed condition.

Referring to FIG. 1 of the drawings, the circuit breaker shown therein has a molded insulating housing 2 which has a shallow cavity 2*a* formed therein to receive the operating mechanism of the circuit breaker. While not shown in the drawings, a molded cover of identical exterior outline is disposed over the open side of the housing 2 to close off the cavity 2*a* and is secured thereto by a plurality of rivets which are received within openings 2*b* of the housing and corresponding openings in the cover. The housing and cover are provided with suitable projections and configurations at their interior surfaces for supporting the operating mechanism of the circuit breaker as described hereinafter. The forward or upper wall of housing 2 has an opening 2*c* which cooperates with a similar opening in the cover for receiving an operating handle 4 of the circuit breaker. The operating handle has a pair of trunions 4*a* which are received within cooperating cylindrical recesses in the housing and cover, respectively, to journal the handle for pivotal movement.

A stationary contact 6*a* is mounted on a stationary contact terminal 6 which is positioned within a suitable configured recess along the lower wall of housing 2. The stationary contact terminal 6 has a plug-in connector 6*b* attached to its left-hand end to project out the bottom or rear of the housing for attachment to a panelboard or the like. A movable contact arm 8 is pivotally supported at the end of a radially projecting leg 10*a* of a latch lever 10 which in turn is pivotally supported upon a pin 2*d* projecting from the rear wall of the cavity 2*a* of housing 2. The movable contact arm 8 is an offset member having a first vertical portion 8*a* as oriented in the drawings to which a movable contact element 8*b* is attached for cooperative engagement with the stationary contact element 6*a*. A second vertical portion 8*c* of the movable contact arm is laterally offset from the first portion and has a pivot arm 8*d* extending to the right therefrom. The uppermost portion 8*e* of the contact arm 8 is formed obliquely to the left as seen in the drawings for reasons that will become more apparent hereinafter. The latch lever 10 is provided with a second radial projection 10*b* which extends toward the lower side of the handle 4. A third radial extension 10*c* of latch lever 10 extends upward and to the right as viewed in the drawings, essentially perpendicular to the extensions 10*a* and 10*b* and provides a latching surface for the latch lever 10. The movable contact arm 8 and latch lever 10 are connected by a pivot pin such as a rivet 12 or the like.

A helical spring 14 is connected in tension between a projection 2*e* in the cavity of housing 2 and lower vertical portion 8*a* of contact arm 8 to serve as a drive spring for the movable contact arm. An insulator 16, which is slotted to receive the movable contact arm 8 therein, is disposed within suitable grooves in the housing and cover to be positioned below the drive spring 14 and above the movable contact element 8*b* of contact arm 8 to prevent an arc drawn between the movable and stationary contacts from striking the drive spring 14.

A toggle linkage comprising a toggle lever 18 and a guide pin 20 is connected at one end to the underside of handle 4 by a cylindrical configuration 18*a* at the end of toggle lever 18 which is received within a complementary recess formed in the underside of the handle 4. The other end of the toggle linkage is pivotally connected to a projection 2*f* formed in the cavity 2*a* of housing 2 by a formed hinge on one end of guide pin 20. The opposite end of guide pin 20 is received within an opening in the corresponding end 18*b* of the toggle lever 18 to form a central knee joint of the toggle linkage. A helical main spring 22 is connected in tension between the toggle lever 18 and the portion 8*c* of the movable contact arm 8. It will be seen that the toggle lever 18 forms an overcenter toggle linkage with respect to the operating handle 4 wherein the pivotal axis of the connection of toggle lever 18 with handle 4 lies to one side of the line of action extending between the pivot of the knee and the axis for pivotal movement of the handle 4 as determined by the trunions 4*a*. The tension force applied to the toggle lever 18 at the knee by the main spring 22 causes the toggle lever 18 to urge the handle 4 to the position shown in FIG. 1.

A trip lever 24 is pivotally mounted within the housing 2 upon a projection 2*g* extending from the rear of cavity 2*a* of the housing. The trip lever 24 is made of a ferrous material and has a depending leg 24*a* extending from the right-hand end thereof to serve as an armature for a magnetic trip structure for the circuit breaker. A helical spring 26 positioned at one end within a recess 2*h* formed in the cavity 2*a* of housing 2 and at the other end around a tongue 24*b* formed on the trip lever 24 to provide the trip lever with a counterclockwise bias as viewed in the drawings. A bimetal member 28 is welded at its lower end to a conductor strap 30 which is in turn received within the opening of a pressure connector 32 positioned within a suitable pocket in the housing 2 of the circuit breaker. The connector 32 receives a wire (not shown) therein for connecting the circuit breaker to a branch circuit. Bimetal element 28 extends upwardly essentially parallel to armature 24*a* but spaced therefrom. Affixed to bimetal member 28 is a U-shaped ferrous core 34, the legs of which extend around the bimetal and provide aligned pole faces against which the armature 24*a* is attracted. A flexible braided connector 36 is attached at one end at the near side, or cover side, of the movable contact arm oblique portion 8*e* and at its other end to the upper end of bimetal element 28 to provide a complete current path through the circuit breaker from the plug-in contact 6*b*, through stationary contact terminal 6 and stationary contact 6*a*, movable contact 8*b* and movable contact arm 8, flexible braid 36, bimetal element 28 and conductor strap 30 to a conductor received within wiring terminal 32. In this arrangement, the bimetal element 28 serves as a single turn winding for the electromagnet comprising core 34 and armature 24*a*. An adjusting screw 38 is provided in the upper right-hand portion of the circuit breaker housing to bear upon the armature 24*a* of trip lever 24 to adjust the spacing between the armature and pole faces of the core 34 to adjust the current level at which the breaker will magnetically trip.

A common trip cam 40 is also journaled for rotation in the housing and cover of the circuit breaker and has slotted ends which are exposed to the respective exterior sides of the circuit breaker for splined connection with adjacent circuit breakers when utilized in a multipole manner. The common trip cam 40 has a first radially projecting lobe 40*a* which is positioned below a projection 10*d* on the latch lever 10 for engagement by that portion of the latch lever when the latter is released by the trip lever 24. Thus the latch lever of a tripped pole of a multipole breaker will cause rotation of the trip cam 40 in other poles of that breaker arrangement. The common trip cam 40 is provided with a second outwardly projecting lobe 40*b* which is positioned adjacent a projection 24*c* on the trip lever to engage that portion of the trip lever and rotate the trip lever in any associated untripped pole upon the aforedescribed movement of the cam by the latch lever, thereby to trip all of the poles of the multipole breaker simultaneously.

Figure 2:
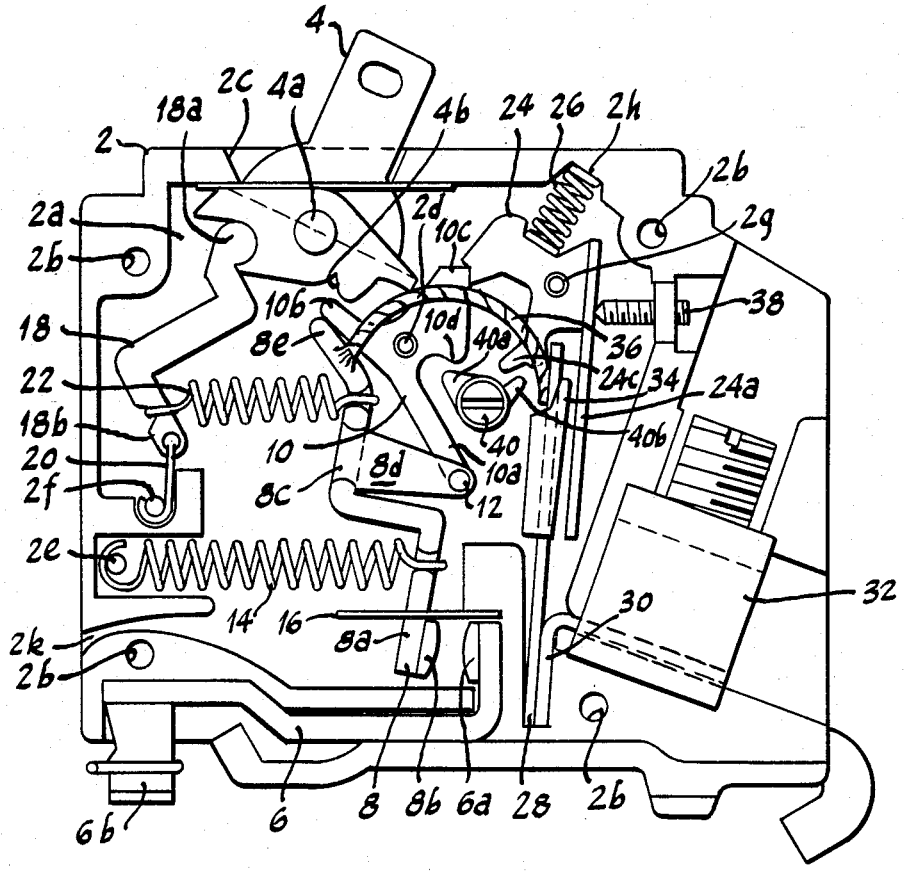
FIG. 2 is a view similar to FIG. 1 but showing the mechanism in a contact open position.
Figure 3:
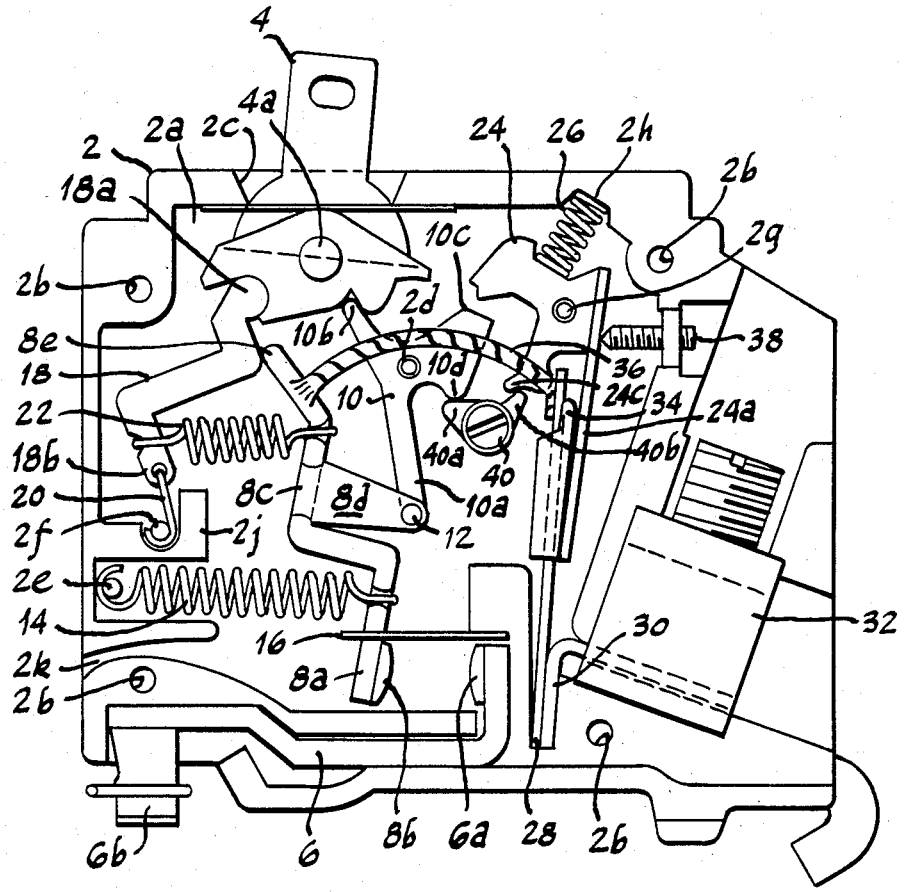
FIG. 3 is a view similar to FIGS. 1 and 2 showing the mechanism in a tripped position.

In operation, the breaker may be operated from its contact closed position as shown in FIG. 1 to its contact open position as shown in FIG. 2 by manually pivoting the handle 4 clockwise over to the right as viewed in the drawings. This movement carries the upper end 18*a* of the toggle lever 18 overcenter of the line of action between the pivot of handle 4 and the knee portion of the toggle linkage under the bias of main spring 22. Thus the toggle lever 18 serves to positively drive the handle 4 to the right once the upper end 18*a* of the toggle lever 18 crosses the line of action and to maintain the handle 4 in that position. During this motion the knee, formed by the opposite end 18*b* of the toggle lever and the upper end of guide pin 20, is permitted to move clockwise to the right as viewed in the drawings and as limited by engagement of the guide pin 20 with a fixed stop 2*j* within the housing. This movement occurs under the bias of main spring 22 and serves to decrease the length of that spring, thereby decreasing the force applied by the main spring 22 to the movable contact arm 8. The force applied by main spring 22 to the movable contact arm 8 provides a counterclockwise moment for contact arm 8 about the pivotal support provided by rivet 12. The drive spring 14, operating in tension between the projection 2*e* and the lower portion 8*a* of movable contact arm 8 provides a counteractive clockwise moment for contact arm 8 about this same pivot. Moreover, in the contact closed position the reaction force provided by the stationary contact 6*a* acting against movable contact 8*b* also provides a clockwise moment about the pivotal support 12. When the force in main spring 22 is reduced by the aforementioned decreased length, the counterclockwise moment about the pivot 12 is reduced to an amount less than the clockwise moment provided by the drive spring 14, and the latter causes the movable contact arm 8 to pivotally move in the contact opening direction to the position shown in FIG. 2. Return movement of the handle 4 to the "ON" position of FIG. 1 carries the upper end 18*a* of toggle lever 18 back across the line of action extending between the trunions 4*a* and the knee of the toggle linkage at the opposite end 18*b* of the toggle lever to bias the handle to the position shown in FIG. 1. Such action causes the toggle lever 18 to drive the guide pin 20 counterclockwise to the left to the position as viewed in FIG. 1, thereby to increase the length and the force of main spring 22 to again provide a moment about the pivot point 12 for contact arm 8 which is greater than that counterclockwise moment provided by the drive spring 14. Thus the movable contact arm 8 will be urged by the main spring 22 to pivot into engagement with stationary contact 6*a*.

Upon the occurrence of a fault current condition, current flow through bimetal 28 creates a magnetic field in core 34 such that the armature 24*a* of trip lever 24 is attracted to the pole faces of the core. This provides a clockwise movement against the bias of compression spring 26 for the trip lever 24 to release the latch lever 10. When the latch lever 10 is released, it effectively releases the pivot location for movable contact arm 8 such that both the main spring 22 and the drive spring 14 are now located on the same side of any restraining pivot for the movable contact arm 8 such as the pivot 2*d* for the latch lever 10. Accordingly, the two springs combine to provide a unidirectional force to the left to pull the movable contact arm 8 substantially linearly away from the stationary contact 6*a*.

Housing 2 is provided with an exhaust vent passageway 2*k* immediately above the plug-in terminal 6*b*. Passageway 2*k* extends to the left from stationary contact 6*a* to the exterior of the housing 2. This arrangement requires arc gases created by any arc resulting between the separating contacts 8*b* and 6*a* to be vented to the left in the same direction as the movement of movable contact arm 8. This construction takes advantage of the pressure from the arc gases and utilizes the force associated with that pressure in such a way as to provide cumulative force with the forces provided on the movable contact arm 8 by the main spring 22 and the drive spring 14. Thus under tripped conditions the movable contact arm 8 moves rapidly away from the stationary contact 6*a*. The movement of the movable contact arm 8 to the left is arrested by engagement of the upper end 8*e* of the movable contact arm with a portion of the toggle lever 18 to bias the handle 4 in a clockwise direction. Movement of the handle 4 is arrested by engagement of a depending surface 4*b* on the handle with projection 10*b* of the latch lever. In the approximately vertical position of handle 4 the forces operating on the end 8*e* of the contact arm and the projection 10*b* of the latch lever are balanced and the contact arm 8 and handle 4 are stopped. This movement affords a larger contact gap in the tripped condition than was provided in the latched position when the contact arm was operated between open and closed positions by manual operation of the handle.

To reset the breaker from the tripped condition, it is necessary to move the handle clockwise to the full "OFF" position of the circuit breaker, thereby to rotate the latch lever 10 counterclockwise to a point where it engages the trip lever 24 to be latched in that position. Subsequent movement of the handle to the "ON" position will cause the movable contact arm 8 to be moved to the closed contact position with stationary contact 6*a* as previously described.

The foregoing has described a circuit breaker wherein contacts manually controllable and movable between open and closed conditions are operable under fault current conditions to separate at a significantly greater speed and open to a significantly greater gap than is achieved during manual operation. The exhausting of arc gasses generated during contact separation is directed in the contact opening direction whereby the forces associated with the arc further accelerate the movable contact in the tripped condition. While a single preferred embodiment of the circuit breaker of this invention has been described herein, it is to be understood that it is susceptible of various modifications without departing from the scope of the appended claims.

I claim:

1. An electric circuit breaker comprising a movable contact arm pivotally supported on a latch lever for movement between open and closed contact positions by a pair of springs connected to said contact arm at opposite sides of said contact arm pivotal support for biasing said arm in opposite pivotal directions, operating means having connection with one of said springs and being manually operable for varying the force applied to said arm by said one of said springs to be greater or less than the force applied to said arm by the other of said springs for moving said contact arm in respective opposite rotational directions between said open and closed contact positions, and current responsive trip means normally latching said latch lever and being operable for releasing said latch lever, said springs upon release of said lever providing a unidirectional bias on said latch lever and said contact arm for moving said contact arm to a contact open position.

2. The invention defined in claim 1 wherein said operating means comprises a manually movable handle and a toggle linkage having one end connected thereto, said one of said spring means being connected to a knee of said toggle linkage.

3. The invention defined in claim 2 wherein said force in said one of said springs is varied by increasing and decreasing the length of said one of said springs.

4. The invention defined in claim 3 wherein said toggle linkage is movable toward a straightened condition for decreasing the length of said one of said springs and toward a collapsed condition for increasing the length of said one of said springs.

5. The invention defined in claim 4 further comprising stop means for preventing said knee from moving overcenter of said toggle linkage.

6. The invention defined in claim 2 wherein said handle is supported for pivotal movement and said one end of said toggle linkage forms an overcenter linkage with said handle between said knee and the pivot of said handle for providing distinct operating positions for said operating means.

7. The invention defined in claim 1 further comprising means defining a passageway for venting arc gases in the direction of contact opening movement of said contact arm responsive to operation of said trip means.

8. The invention defined in claim 7 wherein said movement of said contact arm responsive to operation of said trip means is substantially linear.

9. An electric circuit breaker comprising, in combination:

a housing;

a stationary contact mounted in said housing;

a latch member pivotally mounted in said housing;

current responsive trip means mounted in said housing for latching said latch member;

a pivotal support on said latch member for pivotally supporting a movable contact arm having a movable contact carried thereon;

operating means mounted in said housing for movement between first and second positions;

a first spring connected between said movable contact arm and said operating means, and a second spring connected between said movable contact arm and said housing, said first and second springs being connected to said movable contact arm on opposite sides of said pivotal support for biasing said arm in opposite rotational directions and said first and second springs both being connected to said movable contact arm on the same side of said pivotal mounting for said latch member;

said operating means being manually movable to said first position for increasing a force applied to said movable contact arm by said first spring for applying a first rotational moment to said movable contact arm greater than an opposing second rotational moment applied thereto by said second spring for closing said movable contact on said stationary contact and being manually movable to said second position for decreasing said force applied to said movable contact arm by said first spring and reducing said first rotational moment to a value less than said second rotational moment applied to said movable contact arm by said second spring for opening said movable and stationary contacts; and said current responsive trip means being operab independently of said operating means in response to predetermined current flow through said movable and stationary contacts for releasing said latch member, said first and second spring applying a combined unidirectional moment to said movable contact arm about said pivotal mounting for said latch member for rapidly opening said movable and stationary contacts.

10. The invention defined in claim 9 further comprising an exhaust passageway in said housing extending from said stationary contact to an exterior surface of said housing in the direction of opening movement of said movable contact wherein arc gases established upon opening of said contacts produce a force on said movable contact which is additive to said combined unidirectional moment of said first and second springs to rapidly separate said contacts.

11. The invention defined in claim 9 wherein contact opening movement of said movable contact in response to operation of said trip means is at a significantly higher velocity than opening movement of said movable contact in response to operation of said manual operating means.

12. The invention defined in claim 9 wherein said movable contact opens to a significantly greater gap with respect to said stationary contact in response to operation of said trip means than in response to operation of said manual operating means.

13. The invention defined in claim 9 wherein said opening movement of said movable contact from said stationary contact in response to operation of said trip means is substantially linear and directly away from said stationary contact.

14. The invention defined in claim 9 wherein said operating means comprises a manually operable handle and a toggle linkage connected at one end to said handle, said first spring being connected to said linkage at a knee thereof.

15. The invention defined in claim 14 wherein said first spring biases said toggle linkage toward a straightened condition and said handle is movable to move said toggle linkage toward a collapsed condition for increasing the force in said first spring.

16. The invention defined in claim 14 wherein said handle is supported for pivotal movement and said one end of said toggle linkage forms an overcenter linkage with said handle between said knee and the pivot of said handle for providing defined operating positions for said operating means.

17. The invention defined in claim 14 further comprising stop means for preventing said knee from moving overcenter of said toggle linkage.

18. The invention defined in claim 14 wherein said movable contact arm abuts said operating means during movement of said arm in response to operation of said trip means for driving said handle to a trip indicating position.

19. The invention defined in claim 9 wherein said pivotally mounted latch lever comprises a radially extending portion, said pivotal support for said movable contact arm being located on said radially extending position, and said first and second springs are connected to said movable contact arm respectively on opposite sides of said movable contact arm pivotal support and on the same side of said latch lever pivotal mounting.

* * * * *